United States Patent [19]

Pachmayr et al.

[11] 3,992,823

[45] Nov. 23, 1976

[54] APPARATUS AND METHODS FOR SHAPING RECOIL PADS

[75] Inventors: Frank A. Pachmayr, Los Angeles; Jack R. Farrar, Whittier, both of Calif.

[73] Assignee: Pachmayr Gun Works, Inc., Los Angeles, Calif.

[22] Filed: Feb. 23, 1976

[21] Appl. No.: 660,418

[52] U.S. Cl. ..... 51/281 R; 51/124 R; 51/127; 144/145 R

[51] Int. Cl.[2] ..... B24B 19/08

[58] Field of Search ..... 51/109 R, 97 NC, 124 R, 51/281 R, 281 C, 101 R, 127; 144/145 R, 145 B, 136 J

[56] References Cited

UNITED STATES PATENTS

| | | | |
|---|---|---|---|
| 652,500 | 6/1900 | Austin | 144/145 B |
| 2,850,060 | 9/1958 | Voelz | 144/136 J |
| 3,674,451 | 7/1972 | Hameister et al. | 51/127 |

*Primary Examiner*—Al Lawrence Smith
*Assistant Examiner*—K. J. Ramsey
*Attorney, Agent, or Firm*—William P. Green

[57] ABSTRACT

Apparatus and methods for shaping a gun recoil pad, by mounting a gun stock and carried initially oversize pad for universal pivotal movement about a predetermined center while the stock is turned about generally its longitudinal axis relative to an abrading unit which then progressively abrades away the excess material at the periphery of the pad to form a surface which is aligned with and is essentially a continuation of the outer surface of the gun stock itself at its butt end.

31 Claims, 20 Drawing Figures

FIG. 9
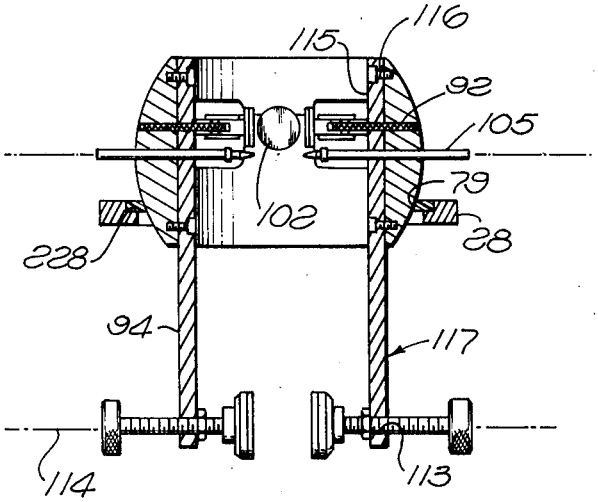
FIG. 10
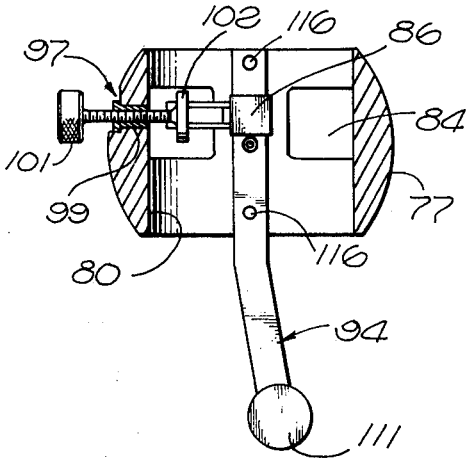
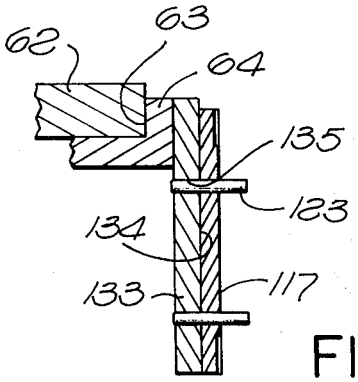
FIG. 7
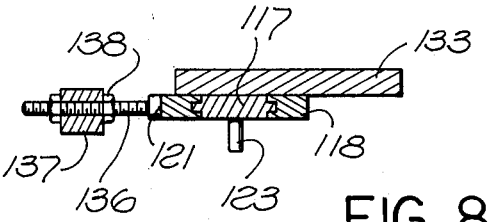
FIG. 8
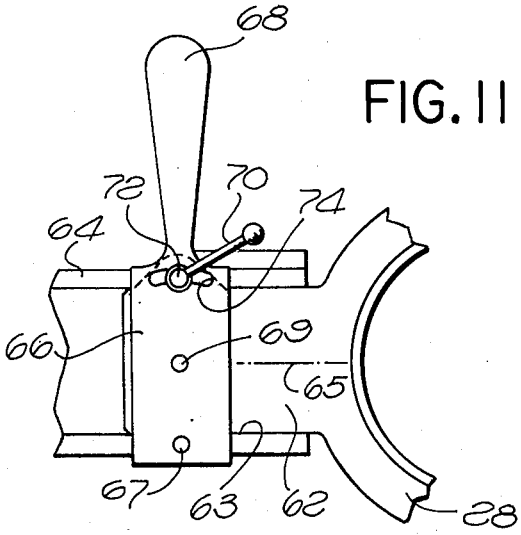
FIG. 11
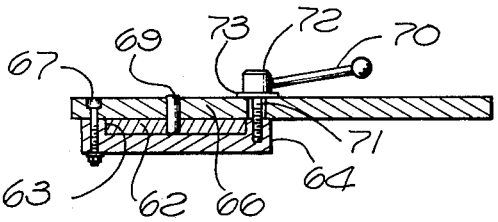
FIG. 12

APPARATUS AND METHODS FOR SHAPING RECOIL PADS

BACKGROUND OF THE INVENTION

This invention relates to improved apparatus and methods for sanding or otherwise abrading the periphery of a recoil pad to a shape corresponding to the butt end of a gun stock to which the pad is connected.

In fitting a recoil pad to a gun stock, it is conventional to initially form the pad to a size slightly greater than the butt end of the gun, and to then sand or grind away the outer surface of the pad until it is aligned with the outer surface of the rear portion of the gun at all points thereabout. This sanding operation must usually be performed by highly skilled persons, who in spite of their skill must work very carefully in order to give the outer surface of the pad a smooth and neat appearance, and to at the same time avoid damaging the adjacent surfaces of the gun stock, with the result that the overall operation must necessarily consume a very substantial amount of time and therefore involve substantially more expense to the customer than would be desired. If a power sander is employed to perform the sanding operation, a relatively slight accidental movement of the gun and pad during the sanding operation can cause the sander to gouge into the pad and/or gun in a manner marring the appearance of one or both of these elements beyond correction or repair.

SUMMARY OF THE INVENTION

The general purpose of the present invention is to provide improved apparatus and methods which can abrade away the excess material of a recoil pad carried by a gun stock in a much more controlled manner than that discussed above, and particularly by a procedure which enables a person who does not have the high degree of skill heretofore required to grind away the periphery of the recoil pad very precisely and uniformly and to a contour corresponding closely to that of the adjacent butt end of the gun stock. When a pad is sanded by the apparatus and methods of the invention, different portions of the periphery of the pad are automatically shaped to extend at different angles with respect to the longitudinal axis of the stock, corresponding at each point to the angularity of the directly adjacent portion of the outer surface of the stock, to be accurately aligned therewith and form in effect a continuation thereof giving the combined structure an optimum overall external shape. Further, this precisely predetermined and controlled ultimate shape of the pad, in which the pad surface merges ideally with the adjacent surface of the gun stock, can be produced by the teachings of the present invention in an extremely rapid manner and with very little care as compared with that required in shaping a pad by conventional methods. Beyond this, the apparatus is adapted to be easily adjusted between conditions for shaping pads to differently dimensioned and configured gun stocks, and includes gauge and locating elements for use in taking dimensions and shape readings from a particular gun stock and then applying the results to the apparatus to control its operation.

In shaping a pad in accordance with the invention, a gun stock and carried initially oversize recoil pad are so positioned that the peripheral surface of the pad may contact a power driven abrading unit, such as a rotating sanding disc, with the gun stock then being turned about generally its longitudinal axis so that the abrading unit progressively sands or otherwise abrades away the outer surface of the pad along its peripheral length. The mounting of the gun is such that, as it turns, the stock and carried pad have universal pivotal movement relative to the abrading unit and about a predetermined center which is spaced forwardly from the butt end of the gun, that is, in a direction toward the muzzle end of the gun. This center of universal pivotal movement is desirably spaced a short distance from a plane containing the effective working portion of the abrading unit, preferably being spaced from that plane a distance equal to one-half the minor transverse thickness dimension of the gun stock at its butt end (this minor dimension being defined as its maximum thickness in a direction perpendicular to the direction of its major transverse dimension. The pivotal center is for best results located at a particular location longitudinally of the stock relative to the usual converging oppositely facing surfaces of the stock which define its maximum dimension at its butt end. To shape the pad to an optimum configuration, the center should be positioned at a point at which the converging surfaces if projected forwardly would be spaced apart a distance corresponding to the previously mentioned minor transverse thickness dimension of the butt end of the stock.

The pivotal axis may be shiftable relative to the abrading unit both transversely and longitudinally of the gun stock, for use in conjunction with guns of various different shapes and dimensions, and may be set for a particular stock by use of a gauge element and associated parts, including elongated elements which can be adjusted to a condition of convergence corresponding to that of the gun stock, with the gauge element being insertable between these converging elements to locate the desired pivotal center on the gun stock, and with the gauge block also being utilized as a stop for controlling the position of the pivotal axis relative to the abrading unit.

While in the preferred embodiment of the invention the sanding disc or other abrading unit is located at a fixed position, and the gun and carried pad are mounted by an appropriate universal connection for the desired universal pivotal movement and turning movement, and the invention is described primarily herein as applied to that kind of arrangement, it is contemplated broadly that some of the objects of the invention could be attained by apparatus in which the gun might possibly be fixed in position and the abrading unit might be mounted for universal pivotal movement, or perhaps both elements might be movable, so long as the relative universal movement between the abrading unit and the gun is as set forth hereinbelow and in the claims. In the preferred form shown in the drawings, the gun is mounted by an externally spherically curved part containing a passage through which the gun stock extends and within which it is held, and with the spherical surface being engagable with another spherically curved surface in a relation locating the gun and its carrying parts for the desired universal movement and rotation. A carrier which movably carries the gun and its associated parts may be mounted for shifting movement in two directions to attain the two described positional adjustments for adapting the equipment to shape a pad to a particular stock.

BRIEF DESCRIPTION OF THE DRAWINGS

The above and other features and objects of the invention will be better understood from the following detailed description of the typical embodiment illustrated in the accompanying drawings in which:

FIG. 7 is a fragmentary vertical section taken on line 7—7 of FIG. 3;

FIG. 8 is a fragmentary horizontal section taken on line 8—8 of FIG. 3;

FIG. 9 is a fragmentary essentially vertical section taken on line 9—9 of FIG. 1;

FIG. 10 is a fragmentary vertical section taken on line 10—10 of FIG. 2;

FIG. 11 is a fragmentary plan view taken on line 11—11 of FIG. 1;

FIG. 12 is a fragmentary vertical section taken on line 12—12 of FIG. 1;

DESCRIPTION OF THE PREFERRED EMBODIMENT

Figure 1:
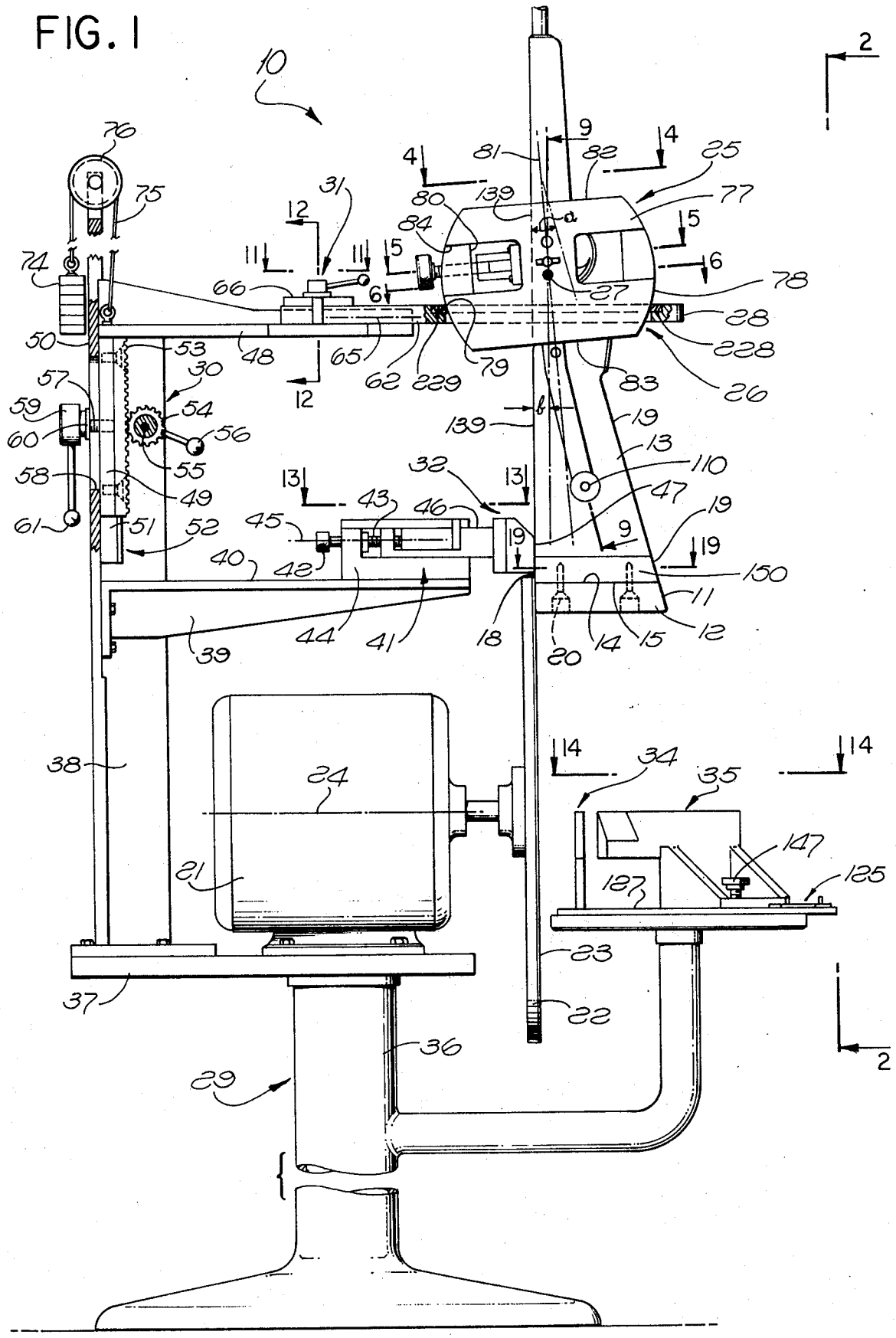
FIG. 1 is a side view of a recoil pad sanding machine constructed in accordance with the invention.
Figure 2:
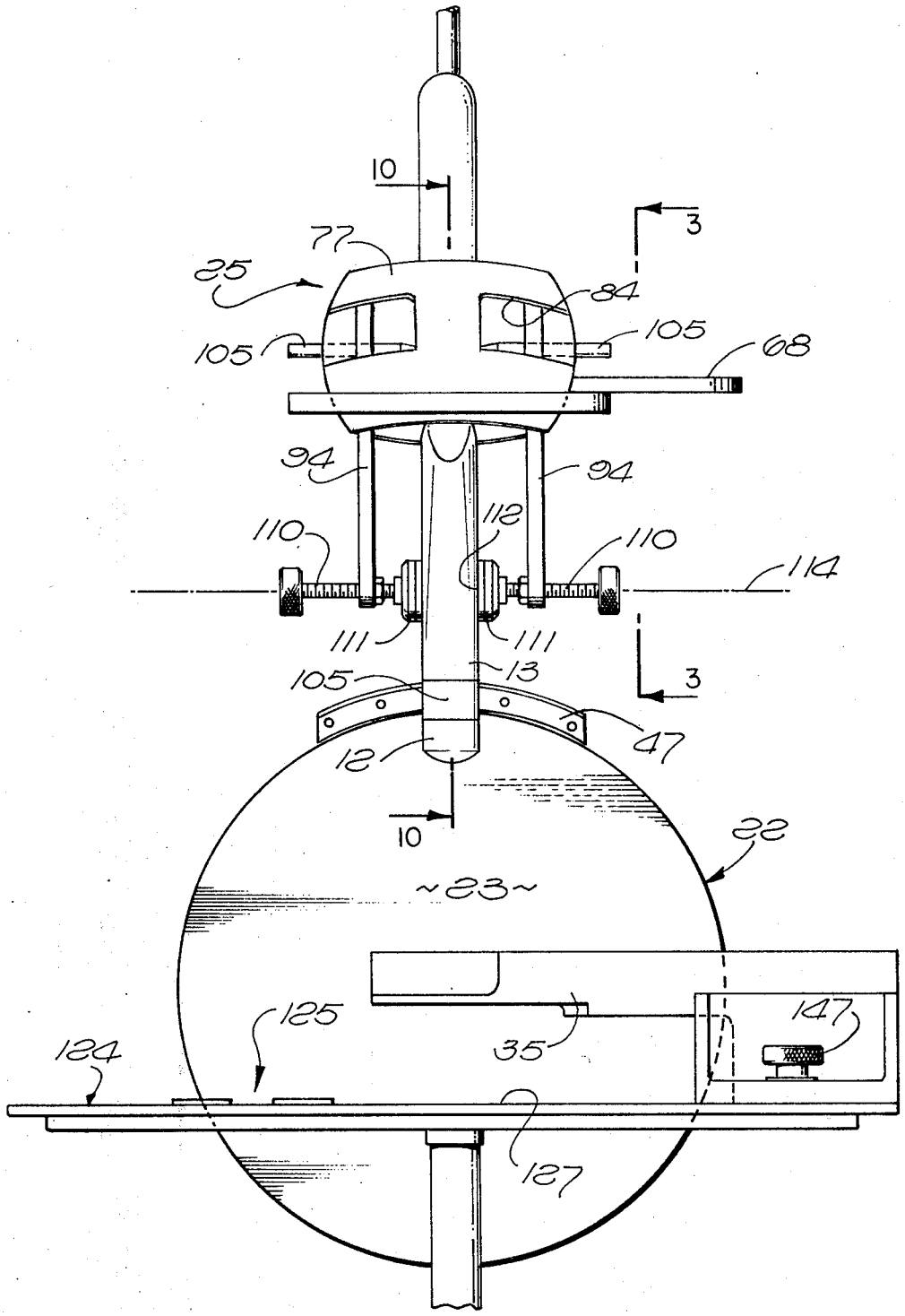
FIG. 2 is a front elevational view taken on line 2-2 of FIG. 1.
Figure 19:
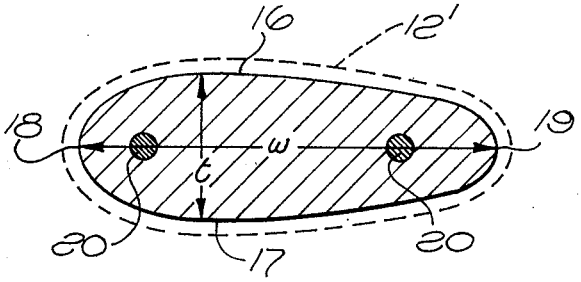
FIG. 19 is an enlarged horizontal section taken on line 19—19 of FIG. 1.
Figure 20:
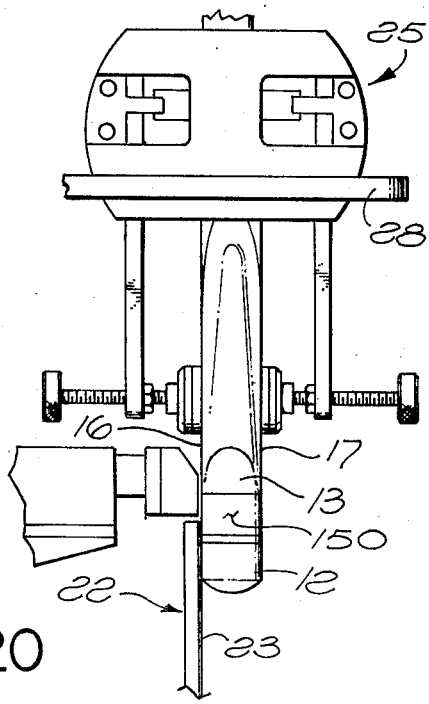
FIG. 20 is a fragmentary view similar to a portion of FIG. 1, but showing the apparatus when the gun stock has been turned through 90° to sand one of the side surfaces of the recoil pad.

Referring first to FIGS. 1 and 2, there is illustrated at 10 a sanding machine which is to be utilized for sanding to a desired shape the peripheral edge surface 11 of a gun recoil pad 12 attached to the butt end of a conventional gun stock 13 of a rifle, shotgun or the like. Pad 12 may be molded of rubber, and has a flat forward face 14 disposed transversely of the longitudinal axis of the gun stock and engaging against a correspondingly transverse planar rear face 15 at the butt end of the stock. The stock at its butt end has a transverse cross-sectional configuration similar to that shown in FIG. 19, defined by opposite side surfaces 16 and 17 which are generally parallel to one another and which merge into oppositely facing curved end surfaces 18 and 19. The maximum transverse dimension *w* of the stock at its butt end is referred to in this description as its "major transverse dimension", while the maximum thickness *t* in a direction perpendicular to dimension *w* is defined as the "minor transverse dimension". Surfaces 18 and 19 in advancing forwardly from the plane of rear face 15 of the stock (upwardly in FIG. 1) converge progressively toward one another at a substantial angle *a*, while the surfaces 16 and 17 normally do not converge as they advance forwardly, or may converge very slightly. Pad 12 may be initially oversize, to project laterally or transversely beyond the periphery of the adjacent butt end portion of the stock entirely about the stock, with this initial oversize condition of the pad being illustrated in broken lines at 12' in FIG. 19. The pad is secured to the gun stock in any appropriate manner, as by screws represented at 20 in FIGS. 1 and 19.

The sanding machine 10 includes an electric motor 21 driving an abrading unit preferably taking the form of a flat sanding disc 22 having a planar sanding face 23 disposed transversely of the axis 24 about which the disc is driven rotatively by motor 21. The gun stock 13 is held during a sanding operation by a holding unit or jig 25, which is mounted by a universal connection 26 for universal pivotal movement about a center 27 relative to a carrier part 28. This carrier is supported movably by the same support structure or base which mounts motor 21, and is rendered adjustably shiftable vertically and horizontally by two connections 30 and 31 respectively. An adjustable guard unit 32 limits the depth of cut which may be taken in the recoil pad by sanding disc 22. An adjustable width gauge unit 33 may be employed to control the positioning of universal pivotal center 27 relative to the sanding disc, and may also be utilized in conjunction with two essentially straight elongated members 34 and 35 in determining the proper location for the pivotal center on the gun stock.

The support structure 29 may include a main lower floor engaging support post 36 carrying at its upper end a rigid horizontal platform 37 on which the motor 21 is mounted in fixed position, and carrying also an upstanding column 38 from which there projects a second platform 39 having a horizontal upper surface 40 to which a unit 41 is mounted for adjustably shifting the guard part 32 rightwardly and leftwardly as viewed in FIG. 1 relative to the sanding disc. As will be understood, manual rotation of a knob 42 turns an advancing screw 43 relative to a support 44 about a horizontal axis 45 parallel to main axis 24 of motor 21, with the screw 43 being fixed against axial movement relative to part 44 and threadedly engaging a second part 46 to move that part rightwardly and leftwardly in accordance with the rotary adjustment of knob 42. The guard element 32 may be curved arcuately about and closely adjacent to the periphery of sanding disc 22 as seen in FIG. 2, and has a vertical stop surface 47 which is engagable with the gun stock to limit its leftward movement in FIG. 1, and which in the FIG. 1 position is essentially aligned vertically with abrading surface 23 of the sanding disc to make a final cut on pad 12, but which may initially be actuated to the right of its FIG. 1 position for lighter initial cuts on the pad.

At a location spaced above the location of the horizontal projection 39, column 38 movably carries an additional essentially horizontal supporting platform 48 which is rigidly attached to a vertical slide plate 49 received adjacent and slidable upwardly and downwardly along vertical portion 50 of the supporting frame, with this structure 48–49 being suitably guided for only vertical movement as by sliding reception of vertical opposite edge portions of plate 49 within a pair of spaced guideway grooves or recesses 51 formed in structures 52 attached rigidly to vertical frame element 50. A rack 53 attached to plate 49 may be engaged by a pinion wheel 54 appropriately mounted to vertical support frame 50 for rotation about a horizontal axis 55, so that manual rotation of the pinion by a connected handle 56 will raise and lower platform 48 relative to the rest of the apparatus. A locking screw 57 threadedly connected into the rear side of plate 49 may extend through a vertical slot 58 in plate 50, and have its head 59 tightenable against washers 60 which bear against the rear face of plate 50 by actuation of a handle 61 to releasably lock parts 48 and 49 in any desired position to which they may be vertically adjusted. This described vertical adjusting mechanism thus constitutes the previously mentioned connection 30 for shifting jig 25 upwardly and downwardly.

The second jig shifting connection 31 may include a rigid essentially rectangular metal plate 62 (FIGS. 1 and 11), confined and slidably guided within a horizontal guideway 63 formed in the upper surface of a rigid horizontal outer portion 64 of the upper platform 48. The sliding plate 62 is rigidly connected to or forms a portion of the carrier 28 which movably supports gun stock holding unit 25. The plate 62 and the carrier or element 28 and supported holding unit 25 are thus guided for sliding movement along the horizontal axis represented at 65 in FIG. 1, which axis is parallel to the previously mentioned axes 24 and 45. Plate 62 is held downwardly within its guide recess 63, and is actuated, by a rigid flat horizontal member 66, which is pivoted at 67 to member 64 at one side of guideway 63, and which extends across the upper side of the guideway and member 62 and has an actuating handle 68 projecting beyond member 64 at that side. Element 66 is pivotally connected to member 62 at 69, so that leftward and rightward swinging movement of handle 68 as viewed in FIG. 11 moves member 62 and the carried parts along axis 65. Element 66 may be locked in any desired adjusted position, by actuation of a locking lever 70, which turns a screw 71 threadedly connected into member 64 to tighten the upper enlarged head 72 of the screw downwardly against one or more washers 73 bearing against, member 66 at opposite sides of an arcuate slot 74 in member 66. The weight of horizontal member 48 and its carried parts may be counterbalanced partially or wholly by a counterweight 74 (FIG. 1), connected to member 48 by a flexible cable 75 extending about an upper idler pulley or wheel 76.

The unit 25 to which gun stock 13 is mounted preferably includes an outer essentially ball shaped element 77, having an outer surface 78 curved spherically about the previously mentioned pivotal center 27. Carrier 28 then may take the form of a ring extending annularly about the lower portion of ball element 77 and carrying a wear resistant low friction liner ring 228, typically formed of teflon and secured to ring 28 by screws 229, with the teflon ring having an annular surface 79 curved spherically in correspondence with and slidably engaging spherically curved surface 78 of ball element 77, to support the ball and mount it for universal pivotal movement relative to the horizontal ring 28 about center 27. This universal mounting of the ball element is also such as to enable the ball and carried gun stock to be turned bodily about a generally vertical axis extending through center 27, to progressively advance different portions of the peripheral surface of recoil pad 12 into contact with the abrading wheel 22.

The ball element 77 contains a cylindrical passage 80 (FIGS. 1 to 6) centered about an axis 81 which extends through the universal pivotal center 27, so that the gun stock can extend vertically through and be held within this annular ball shaped element, with the ball element being cut off at its upper and lower ends transversely at axis 81 at 82 and 83. The side wall of the ball may be cut away at circularly spaced locations (above the level of ring 28) to form four circularly spaced windows 84 for receiving portions of the gun gripping mechanism illustrated in FIG. 5.

Figure 5:
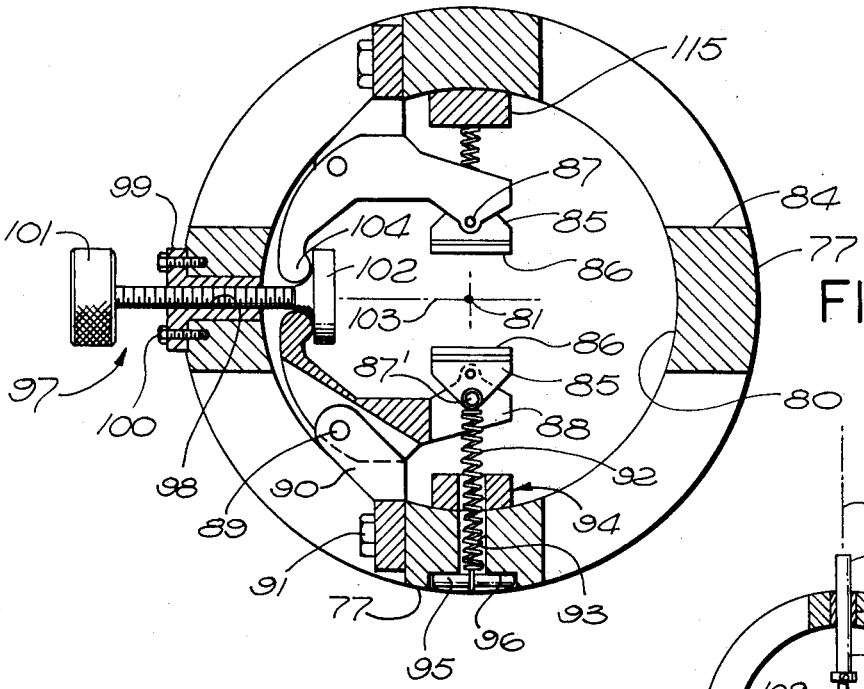
FIGS. 5 and 6 are generally horizontal sections taken on lines 5—5 and 6—6 respectively of FIG. 1.
Figure 6:
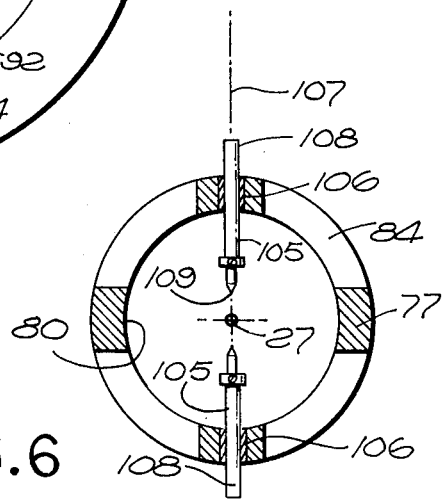
Figure 13:
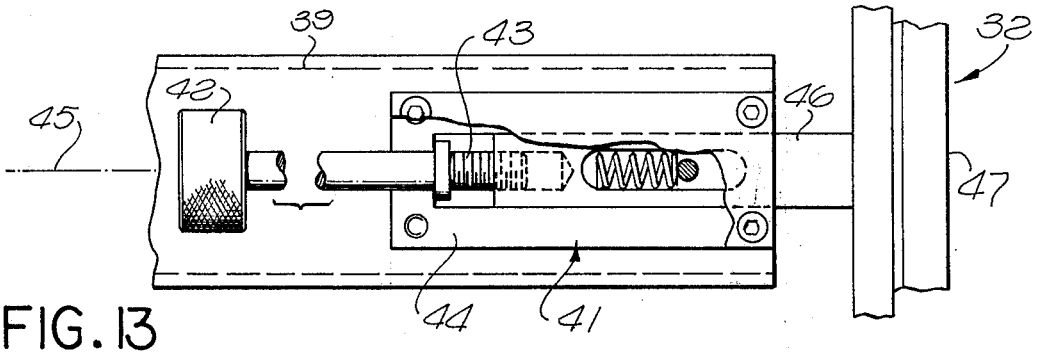
FIGS. 13 and 14 are fragmentary plan views taken on lines 13—13 and 14—14 of FIG. 1.

With reference now to FIG. 5, there are shown in that Figure two opposed gun stock gripping elements 85 having flat cushions 86 which are adapted to engage opposite sides of the gun stock and grip it tightly between these elements in a positive holdling action. Elements 85 may be pivoted at 87 to a pair of bell crank type levers 88, which in turn may be pivoted at 89 to brackets 90 rigidly secured to ball element 77 as by screws 91. Coil springs 92 may be connected to the pivot pins at 87', and extend through passages 93 in opposite sides of element 77 and a pair of arms 94, for connection at their outer ends to a pair of transverse pins 95 received within recesses 96 in the outer surface of ball 77, so that springs 92 may by tension continuously urge elements 85 relatively apart and also to centered pivotal positions in which the faces of their pads 86 are parallel to one another. The two levers 88 are simultaneously actuable in directions moving the pads 86 toward one another and against a gun stock by rotation of an actuating element 97, which threadedly engages at 98 a tubular nut element 99 secured by screws 100 to ball 77. Screw 97 is turned by an outer handle 101, to advance an inner head 102 of the screw radially inwardly and outwardly along an axis 103 extending perpendicular to axis 81 of the ball 77, so that by action against the ends 104 of levers 88 the screw 97 will upon radially outward adjusting movement swing pads 86 simultaneously together and toward axis 81, with the spacing of each pad from axis 81 always being the same as the other pad to attain a self centering action assuring that when the gun stock is ultimately gripped and held by pads 86 it will be precisely centered with respect to axis 81.

As seen in the figures, the gripping mechanism which includes elements 85, 86, 88, 90, 97 and the connected parts is all located slightly above the level of the universal pivotal center 27 of the ball. Just beneath the level of this gripping mechanism, the ball may carry two diametrically opposed center indicating pins 105 (FIG. 6) which are mounted within bushings 106 carried by ball 77 at horizontally diametrically opposed locations for sliding movement radially of the ball and along an axis of 107 which extends through the universal pivotal center 27. These pins 105 may project outwardly beyond the ball, to have extremities 108 by which they may be actuated radially inwardly and outwardly toward and away from center 27, with each of the pins having an inner pointed end 109 which points toward center 27 and may contact the point of the other pin at that center when the two pins are moved inwardly into engagement.

For gripping the gun stock at a location spaced beneath ball 77, there are provided two opposed aligned clamping screws 110 having inner enlarged heads 111 carrying flat gripping cushions 112 for engaging the opposite essentially flat side surfaces of the gun stock. The external threads of screws 110 engage internal threads 113 formed within openings in mounting arms 94 which project downwardly from and are rigidly attached to ball 77. The horizontal axis of adjustment 114 of clamping screws 110 toward and away from the gun stock extends essentially transversely of but may be offset slightly from axis 81 of the ball unit 77. Arms 94 may have upper mounting portions 115 (FIG. 5) which extend vertically along the inner surface 80 of ball element 77 at diametrically opposite locations, and which are suitably rigidly attached to the ball as by screws 116, with the arms 94 preferably having their lower portions 117 turned slightly angularly with respect to their upper portions 115 as seen in FIG. 1, to locate the clamping heads 111 for essentially central engagement with the wider offset portion of the gun stock.

Figure 3:
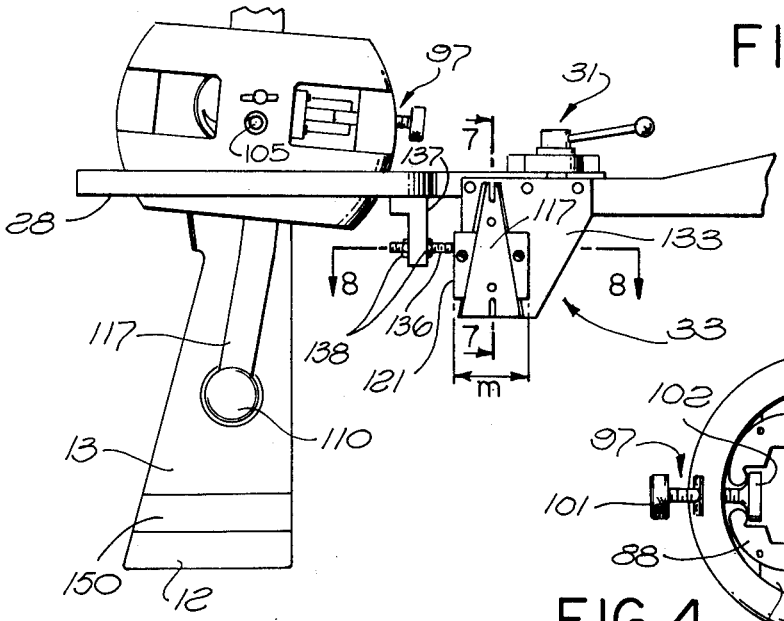
FIG. 3 is an enlarged fragmentary side view taken on line 3—3 of FIG. 2.
Figure 4:
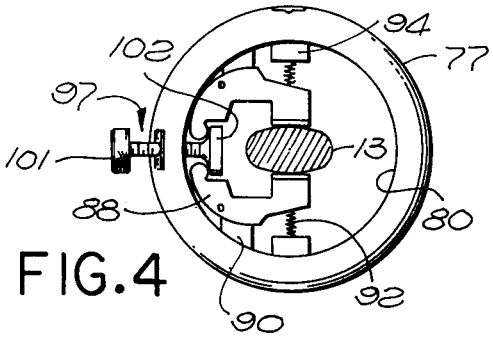
FIG. 4 is an essentially plan view taken on line 4—4 of FIG. 1.
Figure 17:
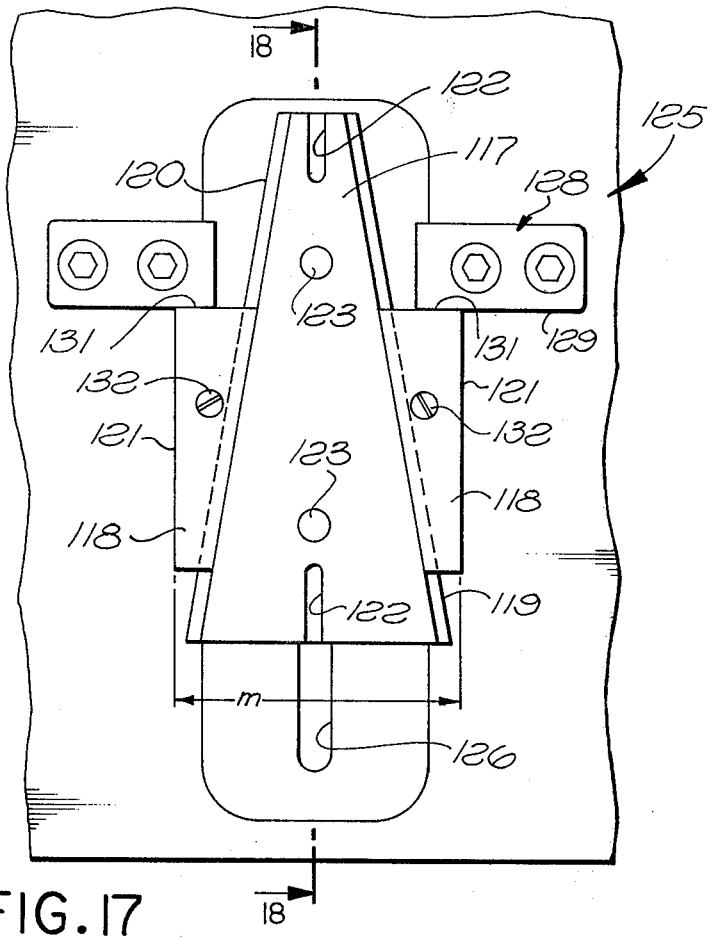
FIG. 17 is a plan view showing the setting gage of the device while it is being adjusted.
Figure 18:
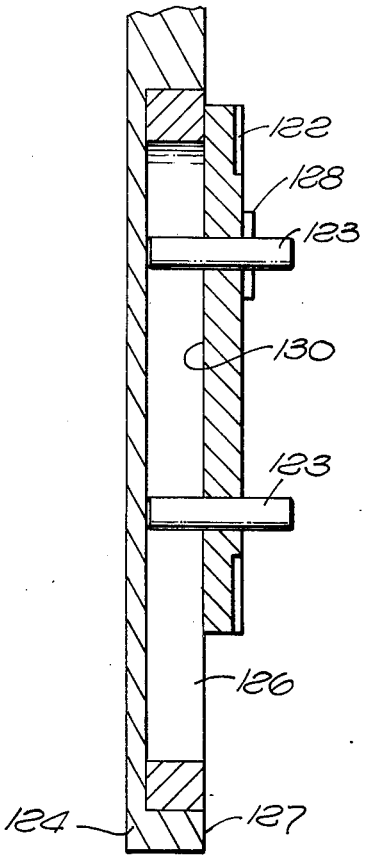
FIG. 18 is a section taken on line 18—18 of FIG. 17.

The gauge element 33 of FIGS. 3 and 17 is adapted to be adjusted to vary its width dimension *m*. For this purpose, the gauge may be formed of a central triangularly shaped part 117 having two similarly shaped elements 118 attached by dove tail connections 119 to the converging opposite edges 120 of the triangle for sliding movement along those edges to vary the spacing between two oppositely facing parallel outer edge surfaces 121 formed on the two parts 118 respectively. At its opposite ends, the central part 117 may have two laterally central narrow slits 122 which are in all conditions of the gauge midway between the planes of the two spaced parallel opposite edge surfaces 121. A pair of parallel pins 123 are connected rigidly to and extend perpendicularly through the triangular central element 117, at locations spaced along its longitudinal central axis, and project in opposite directions therefrom, as seen in FIGS. 7 and 18. For assisting in setting the width of gauge 33, there may be provided on the upper surface of a horizontal front working platform 124 (FIGS. 1, 2 and 14) a setting structure 125, which may consist of a plate 226 containing an elongated slot 126 extending downwardly beneath the level of the upper planar horizontal surfaces 127 of plate 226 of platform 124, and a pair of blocks or lugs 128 projecting upwardly above surfaces 127 at opposite sides of the slot. These lugs 128 are at fixed locations, and have vertical surfaces 129 which are aligned with one another and disposed transversely of the elongated slot 126. The gauge is set in width by positioning it on the upper planar surfaces 127 of platform 124 and plate 226, with aligned planar undersurfaces 130 of parts 117 and 118 slidably engaging surfaces 127 (see FIGS. 17 and 18), and with pins 123 projecting downwardly into and located by slot 126 to slidably guide part 117 for movement longitudinally of slot 126. The end faces 131 of parts 118 are engaged with lugs 128, so that as part 117 is manually slid upwardly as viewed in FIG. 17, it moves relative to parts 118 to cam them apart to increased width positions. The parts 118 may be locked in those set positions in any appropriate manner, as by forming each part 118 of two sections which are tightenable together and into tight gripping engagement with the dovetail ribs on part 117 by screws 132.

Prior to a sanding operation, the adjusted width gauge 33 is mounted on the machine at the location illustrated in FIG. 3, in which it controls and limits the extent to which ball 77 and the attached parts can be moved rightwardly in that figure. For this purpose, the horizontal part 64 to which the ball supporting ring 28 is movably mounted has a downwardly projecting flange 133 (FIG. 7), with a planar vertical face 134 against which the flat surface of gauge 33 is receivable, and with the pins 123 of the gauge projecting into recesses 135 in portion 133 and fitting closely enough therein to frictionally retain the gauge in the position of FIGS. 3 and 7. In that position, one of the side edges 121 of the gauge is engagable with a stop screw 136 which is connected to a downwardly projecting flange 137 carried by ball supporting ring 28, in a relation limiting inward movement of the ball and its associated structure (rightwardly in FIG. 3) when the end of screw 136 engages gauge 33. Screw 136 may be threadedly connected to flange 137, and be locked in fixed position relative thereto by nuts 138. The screw 136 is so adjusted that, when the end of that screw contacts gauge surface 121 and halts rightward movement in FIG. 3, the ball is in that limiting position so located that its center 27 is spaced rightwardly (in FIG. 1) from a vertical plane 139 containing abrading surface 23 or the sanding disc 22 a distance *b* which is exactly equal to onehalf the width dimension *m* to which gauge 33 has been set. When thus positioned, the ball is properly located with respect to the sanding disc to properly form the peripheral surface 11 on recoil pad 12.

Figure 14:
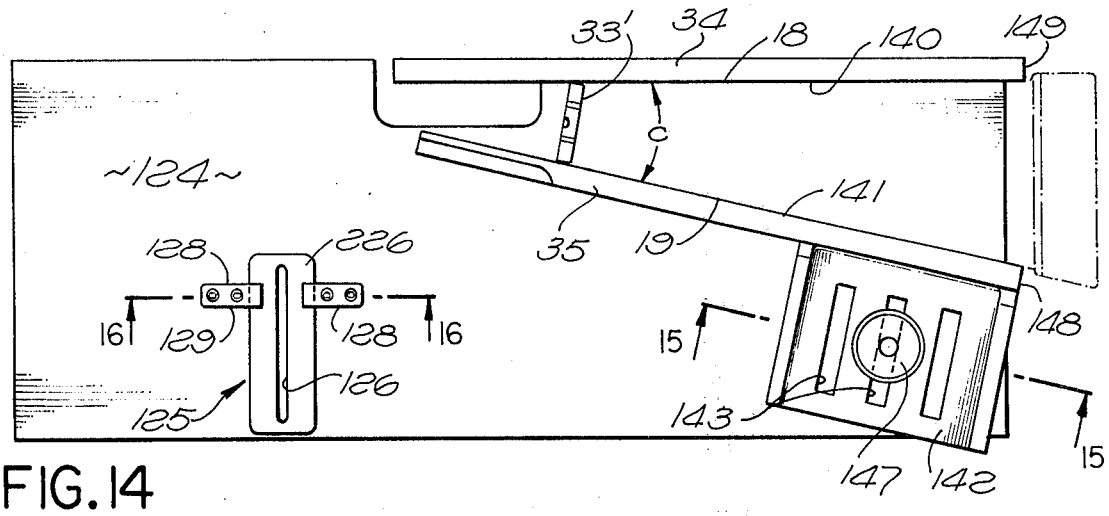
Figure 16:
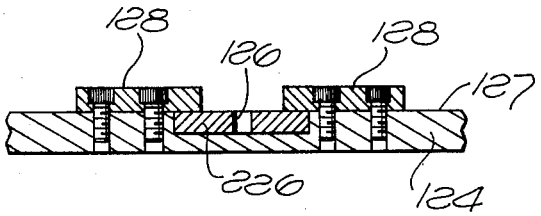
FIGS. 15 and 16 are fragmentary vertical sections taken on lines 15—15 and 16—16 of FIG. 14.

In addition to this critical spacing of center 27 of the ball 77, it is desirable also that the gun stock 13 be located in a predetermined accurately set relationship with respect to ball 77. In order to easily determine the proper setting for the gun stock, there are provided on working platform 124 (which may be supported from the same base 29 as the rest of the frame of the unit) the two previously mentioned relatively shiftable elements 34 and 35 (FIGS. 1 and 14). The first of these elements 34 may be rigidly connected to the rear edge of platform 124, and project vertically upwardly therefrom, and have a vertical planar surface 140 against which the essentially straight upper edge 18 of the gun stock is positioned. The plate 34 may project upwardly a substantial distance above a gun stock positioned as seen in FIG. 14 and if desired may have a lower portion cut away to receive projections which may be formed on the upper edge of the stock at different locations, as for instance on a monte carlo type stock. If such projections are present, the stock is so located that its extreme butt end portion, directly adjacent the recoil pad, is aligned essentially with the inner planar surface 140 of plate 34.

The second plate 35 also projects upwardly from platform 124, and has an inner planar vertical surface 141 which is aligned with and extends along the bottom edge 19 of the gun stock, and which as in the case of plate 34 may if desired by cut away at a lower portion of plate 35 (FIG. 2), to receive projections which may in some instances be formed on the gun stock. The planar surface 141 of plate 35 is at the least aligned with the extreme end portion of edge 19, directly adjacent the recoil pad, so that the two surfaces 140 and 141 are then disposed at an angularity *c* corresponding to the converging angularity of surfaces 18 and 19 directly adjacent the butt end surface 15 of the gun stock and the carried recoil pad 12. This is the angularity which should be formed on the recoil pad in order to cause the outer surface of the recoil pad to merge smoothly with the outer surface of the adjacent portion of the gun stock.

Figure 15:
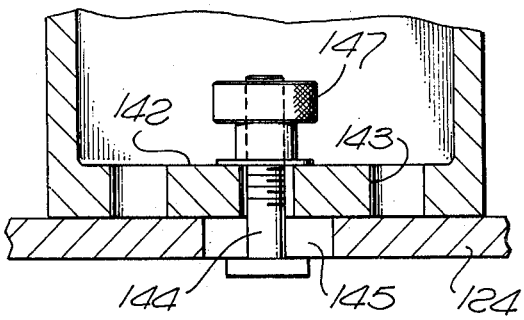

Plate 35 can be mounted for shifting movement to positions of different angularity with respect to plate 34 in any convenient manner, as by providing plate 35 with a horizontal flange 142 (FIGS. 14 and 15), with this flange containing elongated slots 143 through which a screw 144 extends vertically. The lower end of that screw may extend through an angularly disposed slot 145 formed in platform 124, and have a lower enlarged head with a non-circular portion received within slot 145 to prevent rotation of the screw while allowing its sliding movement longitudinally of slot 145. The upper end of that screw may threadedly carry an enlarged nut element 147 which is tightenable relative to the screw and downwardly against flange 142 to lock that flange and the attached element 35 at any desired angularity with respect to plate 34, and with the right hand end 148 of plate 35 in all positions being aligned with the end edge 149 of platform 124. The adjustability of the plate 35 may be further estended by providing more than one of the slots 143 in flange 142, so that the screw may extend through different ones of those slots, and further by providing additional spacers if desired for connection to the inner face 141 of plate 35.

To describe now a cycle of operation of the illustrated machine, a first step may be to measure the minor transverse thickness dimension *t* (FIG. 19) of the particular gun stock to which a recoil pad is being fitted, following which the gauge 33 is adjusted in a manner previously described so that its width *m* between opposite side edges 121 is equal to the measured minor thickness dimension *t* of the gun stock at the location of the butt end surface 12 of the stock. The gauge is locked at this particular width by tightening of screws 132.

The gun stock and attached oversize recoil pad are then placed on the upper surface of platform 124 in the position illustrated in FIG. 14, with the major thickness dimension of the stock extending horizontally and its minor or smaller thickness dimension extending vertically. The stock is so located that as the operator sights directly downwardly along forward surface 140 of plate 134, that surface 140 is exactly aligned with or engaged by the upper edge 18 of the gun stock, and more specifically with that portion of edge 18 which is directly adjacent the recoil pad. Nut 147 is loosened and plate 35 is adjusted to have its right end portion similarly aligned with and disposed at the same angle as lower edge 19 of the gun stock, and specifically the portion of that edge which is directly adjacent the recoil pad, with nut 147 being tightened to lock plate 35 in that position, so that the converging angularity of plates 34 and 35 represents and corresponds exactly to the angle of convergence of the extreme ends portions of gun surfaces 18 and 19 directly adjacent the recoil pad.

With plates 34 and 35 thus set, gauge 33, which has already been adjusted to a width corresponding to the minor thickness dimension of the butt end of the gun stock, is positioned between the two plates 34 and 35, as illustrated in broken lines at 33' in FIG. 14, and is moved along the narrowing space between the two plates 34 and 35 until the gauge reaches a point at which it can just bridge across the space between the two plates, with edges 121 engaging the two plates, and with the gauge disposed at the same angle to both plates. When thus located, a mark is placed on the gun stock at a position directly beneath the center of the gauge, and more specifically directly opposite the lower one of the two center indicating slots 122 of the gauge. This mark placed temporarily on the stock, as by attaching a small piece of tape to the stock and placing a mark thereon with a pencil, indicates the location at which the exact center of universal pivotal movement of the stock should be when the stock is mounted in ball 77.

With the stock thus marked, it is inserted upwardly through the inner passage of ball element 77 and to the position of FIG. 1 and the clamping elements 86 and 110 are tightened against opposite sides of the stock at two vertically spaced locations to tightly secure the stock in fixed position relative to and within ball 77. The upper clamping elements are automatically self centering as discussed, and the lower elements are adjusted manually to similarly center them and the engaged lower portion of the gun stock relative to a plane 152 containing center 27 and disposed perpendicular to the axis 114 of screws 110. As these clamping elements are tightened, the stock is so located that the inner pointed ends 109 of pins 105 of FIG. 6 point directly to the location of the mark which has been placed on the stock to indicate its desired pivotal center, so that the stock is in fact located as desired with that marked point coinciding with the center 27 of universal pivotal movement of the ball. After the gauge 33 has been utililized in the manner discussed to mark the pivotal center on the gun stock, the gauge is positioned on the machine as illustrated in FIG. 3 to act as a stop, and the ball and connected parts are shifted rightwardly in FIG. 3 to bring screw 136 into engagement with surface 121 of the gauge. Motor 121 is then placed in operation to drive the rotary sanding disc 22, and the stock 13 is manually manipulated to bring the peripheral edge 11 of the recoil pad into engagement with the upper edge portion of sanding face 23. The vertical adjustment 30 may be set to properly locate the stock vertically for engagement in this manner of the recoil pad with the desired edge portion of the sanding disc. At the time that the first cut is taken on the recoil pad, the guide element 32 may be adjusted outwardly so that its right face 47 is somewhat to the right of the plane of sanding face 23, with the result that only a portion of the excess material of the recoil pad can be removed on that cut. The portion of the stock adjacent the recoil pad may be protected against accidental marring by applying an adhesive protective tape to that portion of the stock surface, as represented at 150 in FIG. 1.

The gun stock 11 is manipulated manually in any convenient manner, as by grasping the two oppositely projecting screw elements 110, and moving and turning the ball and stock by means of these parts. The stock may first be swung inwardly into engagement with the sanding disc with the gun in the position illustrated in FIG. 1, to bring edge 18 of the gun stock into engagement with guard 32, and bring the corresponding portion of the recoil pad into engagement with the sanding disc, to thereby abrade away a portion of the excess material of the pad. The gun and ball 77 are progressively turned about a generally vertical axis to successively bring different portions of the peripheral edge of the recoil pad into contact with the sanding disc, and thus progressively abrade away a part of the recoil pad entirely about its periphery. As the gun stock and ball are thus turned about a generally vertical axis, they are pivoted universally about center 27 to the extent necessary to bring each of the different portions of the recoil pad into engagement with the sanding disc. After one peripheral cut has been taken in this manner, the element 32 can be reset closer to the plane of abrading face 23, and another cut can be taken, with guard 32 ultimately reaching a position at which its surface 47 is exactly aligned vertically with abrading surface 23, in which condition a final peripheral cut is taken about the recoil pad to form surface 11 to its final configuration.

Because of the discussed universal pivotal mounting of the gun stock, and because of the discussed spacing of the pivotal center 27 the desired distance *b* from the plane of sanding face 23 (a distance equal to one-half of the minor thickness dimension of the gun stock at a location adjacent the recoil pad), and because of the location of the pivotal center 27 with respect to the angle of convergence of stock surfaces 18 and 19, the peripheral surface 11 which is formed on the recoil pad will at all points be substantially aligned with and form in effect a smooth continuation of the corresponding outer surface of the gun stock directly adjacent and directly forwadly of the recoil pad. Thus, the outer surface of the recoil pad is essentially a continuation of the outer surface of the adjacent portion of the gun stock, to present an optimum appearance.

While a certain specific embodiment of the present invention has been disclosed as typical, the invention is of course not limited to this particular form, but rather is applicable broadly to all such variations as fall within the scope of the appended claims.

We claim:

1. Apparatus comprising:

a first unit adapted to hold a gun stock having an initially oversize recoil pad attached to the butt end thereof;

a power driven abrading unit positioned to engage a recoil pad attached to a gun stock held in said first unit and to progressively abrade away the material of said recoil pad along its periphery; and means mounting said first unit and said power driven abrading unit for predetermined movement relative to one another in a relation giving said stock, relative to said abrading unit, universal pivotal movement about a center spaced from said butt end of the gun in a direction toward the muzzle end thereof, while the stock turns relative to said abrading unit about generally the longitudinal axis of the stock, so that said abrading unit forms an edge surface on the recoil pad which along its entire length is essentially aligned with and essentially a continuation of the peripheral surface of the adjacent portion of the gun stock.

2. Apparatus as recited in claim 1, in which said abrading unit is a sanding disc driven rotatively about an axis and having an iregularized sanding face disposed generally transversely of said axis for engaging and abrading the periphery of said recoil pad.

3. Apparatus as recited in claim 1, in which said abrading unit has an abrading face which is positioned to engage and abrade away the periphery of said recoil pad and which lies essentially in a predetermined plane, said center about which the gun stock has universal pivotal movement relative to the abrading unit being spaced from the plane of said abrading face.

4. Apparatus as recited in claim 1, including a gun stock and attached initially oversize recoil pad held by said first unit, said abrading unit having an abrading face which engages and abrades the periphery of said recoil pad and lies essentially in a predetermined plane which is spaced from said center of relative universal pivotal movement of the gun stock a distance essentially equal to one-half of the minor transverse thickness dimension of the gun stock adjacent the recoil pad.

5. Apparatus as recited in claim 1, including a gun stock and attached initially oversize recoil pad held by said first unit, said abrading unit having an abrading face which engages and abrades the periphery of said recoil pad and lies essentially in a predetermined plane which is spaced from said center of relative universal pivotal movement of the gun stock a distance essentially equal to one-half of the minor transverse thickness dimension of the gun stock adjacent the recoil pad, said gun stock at a location adjacent the recoil pad having a maximum transverse dimension defined by oppositely facing surfaces which converge toward one another as they advance forwardly from the recoil pad, said center of universal pivotal movement being located at a point longitudinally of the gun at which said converging surfaces if projected forwardly would be spaced apart a distance essentially equal to said minor transverse thickness dimension of the butt end of the stock adjacent the recoil pad.

6. Apparatus as recited in claim 5, in which said center of universal pivotal movement is located midway between forward projections of said converging surfaces, and midway between forward projections of opposite side surfaces of the minor thickness portion of said butt end of the gun stock adjacent the recoil pad.

7. Apparatus as recited in claim 1, in which said abrading unit has an abrading face for contacting and abrading the periphery of said recoil pad and which lies essentially in a predetermined plane, said mounting means including means for relatively shifting said first unit and said abrading unit to adjustably locate said center of universal pivotal movement different distances from said plane of the abrading face.

8. Apparatus as recited in claim 7, including gauge means adapted to be set to a dimension corresponding to the minor transverse thickness dimension of a gun stock adjacent a carried recoil pad, and adapted when so set to locate said center of universal pivotal movement at a spacing from the plane of said abrading face equal to one-half of said minor transverse thickness dimension of the gun stock.

9. Apparatus as recited in claim 1, in which said mounting means include means for adjustably shifting said center of universal pivotal movement relative to said abrading unit in a direction longitudinally of a gun stock held by said first unit.

10. Apparatus as recited in claim 1, including two relatively shiftable elongated elements for engaging oppositely facing surfaces of a gun stock which converge toward one another in a forward direction at a location adjacent a carried recoil pad, with the elongated elements converging in correspondence with said surfaces, and a gauge element adapted to be adjusted to a width corresponding essentially to a minor transverse thickness dimension of a gun stock adjacent the recoil pad and to then be inserted between said elongated elements in engagement therewith at a location at which said elements are spaced apart a distance equal to said minor transverse thickness dimension of the gun stock, to thereby locate on the gun stock a proper position for said center of universal pivotal movement.

11. Apparatus as recited in claim 10, including a support platform having an upper surface on which a gun stock may be positioned, said elongated elements being carried by said support platform and protecting upwardly above said upper surface thereof, there being means mounting at least one of said elongated elements for shifting movement relative to said platform to positions of different converging angularity with respect to the other elongated element and in accordance with the convergence of opposite surfaces of a gun stock.

12. Apparatus as recited in claim 11, including a gauge setting unit on said platform engageable by said gauge to adjust its width in correspondence with the minimum width of a gun stock.

13. Apparatus comprising:

a support structure;

a motor mounted to said support structure;

an abrading element power driven by said motor and having an abrading face;

a movable holding unit adapted to hold a gun stock having an initially oversized recoil pad attached to the butt end thereof;

a carrier structure mounted to said support structure;

a universal pivotal connection mounting said holding unit and a carried gun stock to said carrier structure in a position for engagement by said abrading surface with a peripheral edge of the recoil pad carried by said gun stock to progressively abrade away the pad along its periphery;

said universal pivotal connection being constructed to mount said holding unit and gun stock to turn about generally a longitudinal axis of the gun stock, while simultaneously pivoting universally about a center which is spaced from said butt end of the gun stock in a direction toward the muzzle end thereof, in a relation to progressively form a peripheral surface on the pad which is essentially aligned with and forms essentially a continuation of an adjacent surface of the butt end of the stock.

14. Apparatus as recited in claim 13, including an additional connection mounting said carrier structure to said support structure for shifting movement relative thereto essentially transversely of a plane essentially containing an operative portion of said abrading face, and to positions in which said center of universal pivotal movement is spaced different distances from said plane.

15. Apparatus as recited in claim 14, including a gauge unit adapted to be adjusted to a width corresponding to the minor transverse thickness dimension of a gun stock at its butt end, and means for mounting said gauge when so adjusted at a predetermined location for engagement with a stop element then operative to automatically limit said shifting movement of said carrier structure at a setting in which said center is spaced from said plane a distance equal to one-half of the width dimension for which said gauge is set.

16. Apparatus as recited in claim 15, including means mounting said carrier structure and connected holding unit and the center of universal pivotal movement therebetween for shifting movement relative to said support structure, there being at least one centering part mounted to said holding unit for shifting movement toward and away from a contained gun stock and positioned to point to and indicate the center of universal pivotal movement of said holding unit on the stock.

17. Apparatus as recited in claim 15, including a third connection mounting said carrier structure and connected holding unit and center of universal pivotal movement therebetween for shifting movement longitudinally of a gun stock carried by the holding unit.

18. Apparatus as recited in claim 17, in which said universal pivotal connection includes an externally spherically curved element containing a central passage through which said gun stock extends and carrying said holding unit and engaging a spherically curved annular surface on said carrier structure in a relation locating said element for universal pivotal movement relative to the carrier structure.

19. Apparatus as recited in claim 18, in which said holding unit includes a pair of jaws carried movably within said externally spherical element and engagable against opposite sides of the gun stock to grip it and hold the stock in fixed position within and relative to said element, and manually actuable means for tightening said jaws against the gun stock in unison and in a self-centering relation.

20. Apparatus as recited in claim 19, in which said holding unit includes two arms carried rigidly by said element and projecting therefrom, and two additional jaws mounted adjustably to said arms and tightenable against opposite sides of said gun stock at a location spaced from said first mentioned jaws.

21. Apparatus as recited in claim 20, including a pair of elongated elements adapted to receive a tapering gun stock therebetween, and adapted to be shifted to positions of convergence in correspondence with the gun stock at a location adjacent its butt end, said gauge being positionable between said elongated elements to bridge thereacross at a location at which the gauge width corresponds to the spacing between said elements, and having a portion then indicating the proper center of universal pivotal movement on the gun stock.

22. Apparatus as recited in claim 13, including an additional connection mounting said carrier structure and connected holding unit and the center of universal pivotal movement therebetween for shifting movement longitudinally of a gun stock carried by the holding unit.

23. Apparatus as recited in claim 13, in which said universal pivotal connection includes an externally spherically curved element containing a central passage through which said gun stock, extends and carrying said holding unit and engaging a spherically curved annular surface on said carried structure in a relation locating said element for universal pivotal movement relative to the carrier structure.

24. Apparatus as recited in claim 23, in which said holding unit includes a pair of jaws carried movably within said externally spherical element and engageable against opposite sides of the gun stock to grip it and hold the stock in fixed position within and relative to said element, and manually actuable means for tightening said jaws against the gun stock in unison and in a self-centering relation.

25. Apparatus as recited in claim 24, in which said holding structure includes two arms carried rigidly by said element and projecting therefrom, and two additional jaws mounted adjustably to said arms and tightenable against opposite sides of said gun stock at a location spaced from said first mentioned jaws.

26. The method of abrading a recoil pad carried by the butt end of a gun stock comprising:

positioning a peripheral surface of the recoil pad in lateral engagement with an abrading surface of a power driven abrading unit; and turning said gun stock about generally its longitudinal axis while maintaining the periphery of the recoil pad in engagement with said abrading surface, and while giving the sun stock and carried pad universal pivotal movement about a predetermined center which is fixed relative to said abrading surface and is spaced forwardly from the butt end of the gun stock in a direction toward its muzzle end, in a relation forming a surface on the periphery of the recoil pad which is aligned with and forms essentially a continuation of the outer surface of an adjacent portion of the gun stock.

27. The method as recited in claim 26, including maintaining said center of universal pivotal movement during the abrading operation at a location spaced from a plane containing an operative portion of the abrading surface a distance corresponding to one-half the minor transverse thickness dimension of the gun stock at its butt end.

28. The method as recited in claim 27, in which said gun stock has a maximum transverse dimension adjacent said butt end of the stock which is defined by surfaces converging as they advance forwardly from said butt end, said center of universal pivotal movement of the gun stock being located at a point longitudinally of the gun stock at which projections of said converging surfaces would be spaced apart a distance corresponding to said minor transverse thickness of the gun stock at its butt end.

29. The method as recited in claim 28, including aligning two elongated elements to converge in correspondence with said converging surfaces of the gun stock, setting a gauge to a width corresponding to the minor transverse thickness of the gun stock adjacent the recoil pad, positioning said gauge between said converging elongaged elements at a location at which it just bridges across the space therebetween, marking the center of universal pivotal movement on the gun stock at a location opposite the center of said gauge when so positioned, and then mounting the gun stock for universal movement about said center during an abrading operation.

30. The method as recited in claim 29, including utilizing said gauge when so set for setting the spacing of said center of universal pivotal movement at a distance spaced from the plane of said abrading surface an amount equal to one-half of the gauge width.

31. The method as recited in claim 26, including setting a gauge to a width corresponding to the minor transverse thickness dimension of the gun stock at its butt end, and utilizing said gauge when so set to locate the center of universal pivotal movement of the gun stock a distance form a plane containing an operative portion of said abrading surface equal to one-half the gauge width.

* * * * *